US010186207B2

(12) United States Patent
Kwon et al.

(10) Patent No.: US 10,186,207 B2
(45) Date of Patent: Jan. 22, 2019

(54) DISPLAY DEVICE FOR ENHANCING A DRIVING SPEED, AND DRIVING METHOD THEREOF

(71) Applicants: SAMSUNG DISPLAY CO., LTD., Yongin-si, Gyeonggi-do (KR); KOREA ADVANCED INSTITUTE OF SCIENCE AND TECHNOLOGY, Yongin-si, Gyeonggi-do (KR)

(72) Inventors: Oh Jo Kwon, Yongin-si (KR); Ji Woong Kim, Yongin-si (KR); Choong Sun Shin, Yongin-si (KR); Joo Hyung Lee, Yongin-si (KR); Jun Suk Bang, Daejeon (KR); Gyu Hyeong Cho, Daejeon (KR)

(73) Assignees: Samsung Display Co., Ltd., Yongin-si (KR); Korea Advanced Institute of Science and Technology, Daejeon (KR)

( * ) Notice: Subject to any disclaimer, the term of this patent is extended or adjusted under 35 U.S.C. 154(b) by 244 days.

(21) Appl. No.: 15/067,986

(22) Filed: Mar. 11, 2016

(65) Prior Publication Data

US 2016/0372044 A1 Dec. 22, 2016

(30) Foreign Application Priority Data

Jun. 16, 2015 (KR) ..... 10-2015-0085448

(51) Int. Cl.
*G09G 3/30* (2006.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2310/027* (2013.01);
(Continued)

(58) Field of Classification Search
CPC ... G09G 3/3275; G09G 3/3291; G09G 3/3233
(Continued)

(56) References Cited

U.S. PATENT DOCUMENTS

2002/0021606 A1* 2/2002 Tsuchi ..... G09G 3/3688 365/203
2002/0145584 A1* 10/2002 Waterman ..... G09G 3/2011 345/98

(Continued)

FOREIGN PATENT DOCUMENTS

KR 10-2006-0053560 A 5/2006
KR 10-2008-0082815 A 9/2008

(Continued)

OTHER PUBLICATIONS

Kim, Seong-Joong, et al., Abstract: Pre-Emphasis Driving Method for Large Size and High Resolution TFT-LCDs, SID Symposium Digest of Technical Papers, Jan. 2003, 1 Page, 34(1).

(Continued)

*Primary Examiner* — Adam J Snyder
(74) *Attorney, Agent, or Firm* — Lewis Roca Rothgerber Christie LLP

(57) ABSTRACT

A display device includes pixels at respective crossing regions of scan lines and data lines, a scan driver that is configured to supply a scan signal to the scan lines, and a data driver that is configured to supply a pre-emphasis voltage to the data lines using a first constant for controlling a voltage value of the pre-emphasis voltage, and using a second constant for controlling a supply time of the pre-emphasis voltage, and supply data signals to the data lines after the supply of the pre-emphasis voltage, wherein at least one of the first or second constants is stored in each channel corresponding to each of the data lines.

20 Claims, 5 Drawing Sheets

(52) U.S. Cl.
CPC ..... *G09G 2310/0248* (2013.01); *G09G 2310/0286* (2013.01); *G09G 2310/0291* (2013.01); *G09G 2310/08* (2013.01); *G09G 2320/0252* (2013.01)

(58) Field of Classification Search
USPC ..... 345/78
See application file for complete search history.

(56) References Cited

U.S. PATENT DOCUMENTS

2004/0257313 A1* 12/2004 Kawashima ..... G09G 3/3283 345/76
2005/0116902 A1* 6/2005 Miyzawa ..... G09G 3/325 345/76
2005/0219166 A1* 10/2005 Kim ..... G09G 3/3241 345/76
2006/0291298 A1* 12/2006 Kang ..... G09G 3/3688 365/189.07
2007/0085810 A1* 4/2007 Lee ..... G09G 3/2011 345/100
2008/0001935 A1* 1/2008 Nurmi ..... G09G 3/006 345/204
2008/0036708 A1* 2/2008 Shirasaki ..... G09G 3/3233 345/76
2008/0218496 A1 9/2008 Song et al.
2009/0058324 A1* 3/2009 Nakao ..... G09G 3/3655 315/307
2011/0102418 A1* 5/2011 Park ..... G09G 3/3233 345/214
2011/0169801 A1* 7/2011 Hsieh ..... G09G 3/2011 345/211
2012/0212474 A1* 8/2012 Hwang ..... G09G 3/3648 345/212
2014/0204071 A1* 7/2014 Kwon ..... G09G 3/3291 345/212

FOREIGN PATENT DOCUMENTS

KR 10-2008-0107064 A 12/2008
KR 10-2012-0094722 A 8/2012
KR 10-2012-0132124 A 12/2012

OTHER PUBLICATIONS

Son, Young-Suk, et al., Abstract: A Gray-Level Dependent Pre-Emphasis Column Driver With Fast Settling for Active-Matrix LCD Applications, IEEE Transactions on Circuits and Systems Part 2 Epress Briefs, Dec. 2007, 1 Page.

* cited by examiner

DISPLAY DEVICE FOR ENHANCING A DRIVING SPEED, AND DRIVING METHOD THEREOF

CROSS-REFERENCE TO RELATED APPLICATION

This application claims priority to, and the benefit of, Korean Patent Application No. 10-2015-0085448, filed on Jun. 16, 2015, in the Korean Intellectual Property Office, the entire contents of which are incorporated herein by reference in their entirety.

BACKGROUND

1. Field

The present disclosure relates to a display device and a driving method thereof, and more particularly, to a display device capable of enhancing a driving speed and reliability, and a driving method thereof.

2. Description of the Related Art

With the developments in information technology, importance on display devices has been highlighted, and display devices such as a liquid crystal display (LCD) device, an organic light emitting diode (OLED) device, and a plasma display panel (PDP) have been widely used.

A display device includes pixels arranged in a matrix form and located at respective crossing regions of scan lines and data lines, and also includes a scan driver for driving the scan lines, and a data driver for driving the data lines.

The scan driver selects groups of the pixels that are in a same line unit by supplying a scan signal to the scan lines. The data driver supplies a data signal to the data lines for synchronization with the scan signal. The pixels selected by the scan signal are charged with a voltage corresponding to the data signal. Thus, the charged pixels display a luminance corresponding to the data signal.

This display device supplies the data signal using a pre-emphasis voltage so that the pixels can be charged with a given voltage. The pre-emphasis voltage is previously set to be lower or higher than the data signal, and is supplied to the data lines before the data signal is supplied thereto. However, the conventional pre-emphasis voltage may limit improvements in a driving speed for each channel, because the pre-emphasis voltage is supplied to all of the channels without regard for a load of the data lines.

SUMMARY

In consideration of the above, a method for setting the pre-emphasis voltage in consideration of the load of the data lines may be beneficial. The present disclosure is directed to providing a display device capable of enhancing a driving speed and reliability thereof, and a method for driving the same.

A display device according to an exemplary embodiment of the present disclosure may include pixels at respective crossing regions of scan lines and data lines, a scan driver that is configured to supply a scan signal to the scan lines, and a data driver that is configured to supply a pre-emphasis voltage to the data lines using a first constant for controlling a voltage value of the pre-emphasis voltage, and using a second constant for controlling a supply time of the pre-emphasis voltage, and supply data signals to the data lines after the supply of the pre-emphasis voltage, wherein at least one of the first or second constants is stored in each channel corresponding to each of the data lines.

An i-th (i is a natural number) channel of the data driver may include a digital-to-analog converter for generating the data signals, a first register for storing the first constant, a pre-emphasis voltage generator for generating the pre-emphasis voltage using the first constant, a first switch for controlling a connection between the pre-emphasis voltage generator and an i-th data line of the data lines, a comparator for comparing a voltage of the i-th data line and voltages of the data signals, and a controller for controlling a value of the first constant based on a comparison result of the comparator.

The i-th channel of the data driver further may include a buffer between the pre-emphasis voltage generator and the first switch.

The data driver may further include a second register for storing the second constant.

The first register may be configured to store the first constant that is set to an intermediate value between a maximum value and a minimum value as an initial value.

The digital-to-analog converter may be configured to supply a first data signal and a second data signal that is different than the first data signal at least two or more times during a load-estimating period in which a value of the first constant is controlled.

The first switch may be configured to be turned off after the first data signal, the pre-emphasis voltage, and the second data signal are successively supplied to the i-th data line during the load-estimating period.

The comparator may be configured to compare a voltage of the i-th data line and a voltage of the second data signal after the first switch is turned off.

An i-th (i is a natural number) channel of the data driver may include a digital-to-analog converter for generating the data signals, a second register for storing the second constant, a pre-emphasis voltage generator for generating the pre-emphasis voltage using the second constant stored in the second register, a first switch for controlling a connection between the pre-emphasis voltage generator and an i-th data line, a comparator for comparing a voltage of the i-th data line and voltages of the data signals, and a controller for controlling a value of the second constant stored in the second register based on a comparison result of the comparator.

The data driver may further include a first register for storing the first constant.

The second register may be configured to store the second constant that is set to an intermediate value between a maximum value and a minimum value as an initial value.

The digital-to-analog converter may be configured to successively supply a first data signal and a second data signal different than the first data signal at least two or more times during a load-estimating period in which a value of the second constant is controlled.

The first switch may be configured to be turned off after the first data signal, the pre-emphasis voltage, and the second data signal are successively supplied to the i-th data line during the load-estimating period.

The comparator may be configured to compare a voltage of the i-th data line and a voltage of the second data signal after the first switch is turned off.

According to another exemplary embodiment of the present disclosure, a method for driving an OLED using a load-estimating period in which at least one of a voltage value of a pre-emphasis voltage and a supply time of the pre-emphasis voltage is controlled, may include, during the load-estimating period, supplying a first data signal and a second data signal different than the first data signal to an i-th (i is a natural number) data line, supplying the pre-emphasis voltage in an early stage in which the second data signal is supplied, floating the i-th data line after the pre-emphasis voltage and the second data signal are supplied, comparing a voltage of the i-th data line and a voltage of the second data signal, and controlling at least one of a voltage value and a supply time of the pre-emphasis voltage based on the comparing.

The controlling at least one of the voltage value and the supply time of the pre-emphasis voltage may include controlling at least one of a first constant for determining the voltage value of the pre-emphasis voltage, or a second constant for determining the supply time of the pre-emphasis voltage.

At least one of the first and second constants may be controlled such that the voltage of the i-th data line and a voltage of the second data signal are similar.

The supplying the first data signal and the second data signal may include supplying the first and second data signals two or more times during the load-estimating period.

The first data signal may be a signal of a lowest voltage supplied from a data driver, and the second data signal may be a signal of a highest voltage supplied from the data driver.

The load-estimating period may be after a power is supplied to the display device.

The exemplary embodiments of the present disclosure can enhance a driving speed and reliability of the display device by determining a voltage value and/or a supply time of the pre-emphasis voltage for each channel corresponding to each column/row of the data lines.

BRIEF DESCRIPTION OF THE DRAWINGS

Example embodiments will now be described more fully hereinafter with reference to the following detailed description of embodiments and the accompanying drawings, wherein.

DETAILED DESCRIPTION

Figure 1:
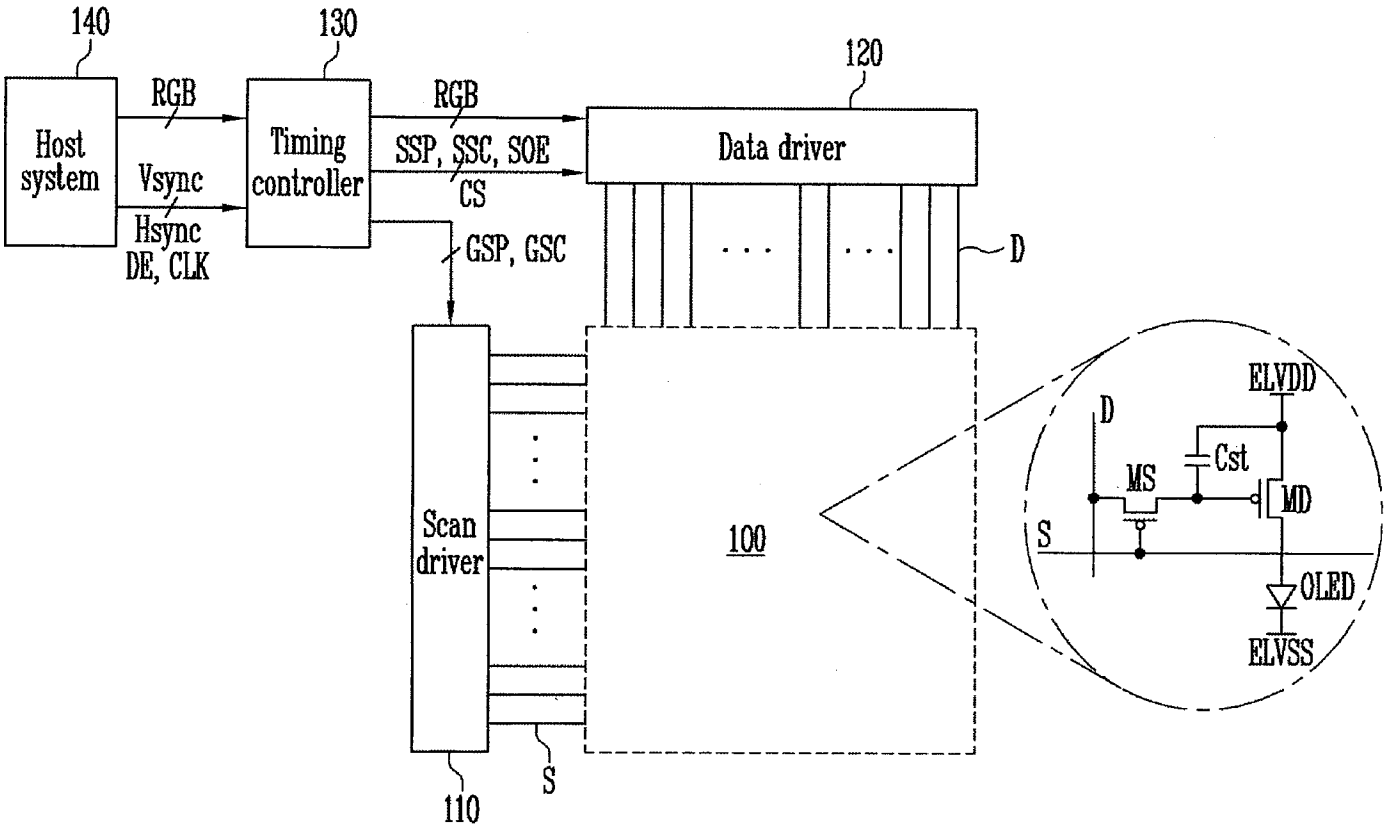
FIG. 1 is a schematic block diagram of a display device according to an exemplary embodiment of the present disclosure.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a schematic block diagram of a display device according to an exemplary embodiment of the present disclosure.

Referring to FIG. 1, the display device according to the exemplary embodiment is an OLED device as a display device, although the present disclosure is not limited thereto, and includes a pixel portion (e.g., a display area/effective display unit) 100, a scan driver 110, a data driver 120, a timing controller 130, and a host system 140.

The pixel portion 100 includes a plurality of pixels arranged within respective regions corresponding to crossing regions of scan lines S and data lines D. Each pixel receives a data signal through a corresponding data line D in response to a scan signal applied from a corresponding scan line S, and generates light having luminance corresponding to the received data signal. For this purpose, each pixel is configured to include an organic light emitting diode OLED, a storage capacitor Cst, and a plurality of transistors, which may include a switching transistor MS and a driving transistor MD. When the scan signal is applied through the scan line S, the switching transistor MS is turned on, thereby electrically connecting the data line D and a gate electrode of the driving transistor MD.

The driving transistor MD controls the amount of current flowing to a second power source ELVSS from a first power source ELVDD via the organic light emitting diode OLED, the current corresponding to a voltage applied to the gate electrode of the driving transistor MD. The storage capacitor Cst is connected between the first power source ELVDD and the gate electrode of the driving transistor MD to store a voltage corresponding the data signal therein.

The scan driver 110 supplies the scan signal to the scan line S, and may do so sequentially. When the scan signals are sequentially supplied to the scan lines S, groups of the pixels are selected by a horizontal line.

The data driver 120 generates an analog data signal using image data RGB, which may be applied from the timing controller 130, and supplies it to the corresponding data line D to synchronize with the scan signal. In addition, the data driver 120 supplies pre-emphasis voltages, which are set equivalently and/or differently for each channel, using a first constant for determining a voltage value of the pre-emphasis voltage, and/or using a second constant for determining a supply time of the pre-emphasis voltage. In this case, the first constant and/or the second constant are stored in each channel, and are set by reflecting a load characteristic of each data line D. This will be described later in more detail.

The timing controller 130 supplies a gate control signal to the scan driver 110, and supplies a data control signal to the data driver 120, based on timing signals applied from the host system 140, such as image data RGB, a vertical synchronization signal Vsync, a horizontal synchronization signal Hsync, a data enable signal DE, and/or a clock signal CLK. Also, the timing controller 130 rearranges the image data RGB, and supplies them to the data driver 120.

The gate control signal includes a gate start pulse GSP and one or more gate shift clocks GSC. The gate start pulse GSP controls a timing of the first scan signal, and the gate shift clock GSC means one or more clock signals for shifting the gate start pulse GSP.

The data control signal includes a source start pulse SSP, a source sampling clock SSC, a source output enable signal SOE, and/or a control signal CS, etc. The source start pulse SSP controls a sampling start time of the image data RGB in the data driver 120, the source sampling clock SSC controls a sampling operation of the data driver 120 based on a falling edge or a rising edge, and the source output enable signal SOE controls an output timing of the data driver 120. The control signal CS is used to set the first constant and/or the second constant.

The host system 140 supplies the image data RGB to the timing controller 130 through a predetermined interface. In addition, it supplies the timing signals, such as the vertical synchronization signal Vsync, the horizontal synchronization signal Hsync, the data enable signal DE, and the clock signal CLK, to the timing controller 130.

Figure 2:
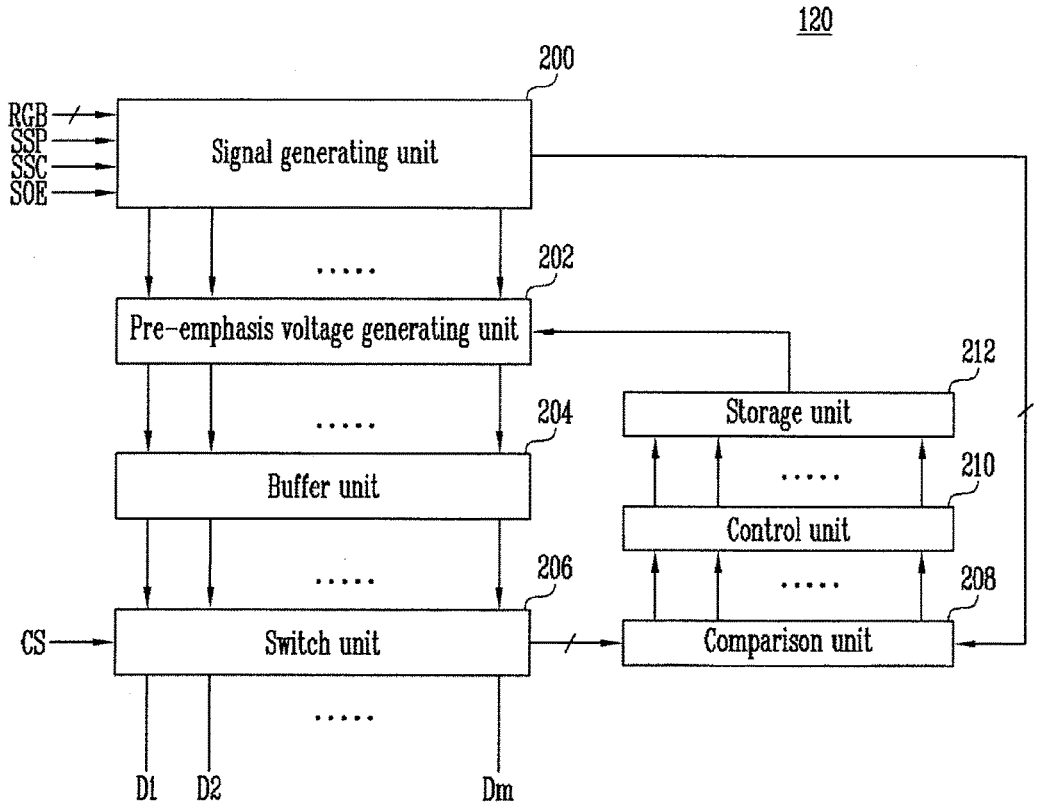
FIG. 2 schematically shows a data driver according to an exemplary embodiment of the present disclosure.

FIG. 2 schematically shows the data driver according to the exemplary embodiment of the present disclosure.

Referring to FIG. 2, the data driver 120 according to the exemplary embodiment of the present disclosure includes m channels (m is a natural number), and includes a signal generating unit 200, a pre-emphasis voltage generating unit 202, a buffer unit 204, a switch unit 206, a comparison unit 208, a control unit 210, and a storage unit 212.

The signal generating unit 200 generates the data signal using the image data RGB, the source start pulse SSP, the source sampling clock SSC, and/or the source output enable signal SOE. For this operation, the signal generating unit 200 may include a shift register, a sampling latch, a holding latch, and/or a digital-to-analog converter. In addition, the signal generating unit 200 may be variously configured in known ways to generate the data signal.

The pre-emphasis voltage generating unit 202 generates the pre-emphasis voltage that is supplied to the data lines D1 to Dm. For example, the pre-emphasis voltage generating unit 202 may generate the pre-emphasis voltage using the first constant and/or the second constant, which are stored in the storage unit 212. In this case, the pre-emphasis voltage generating unit 202 may control a voltage value of the pre-emphasis voltage, which is supplied to each channel, using the first constant stored in each channel. Also, the pre-emphasis voltage generating unit 202 may control a supply time of the pre-emphasis voltage supplied to each channel by using the second constant stored in each channel.

The buffer unit 204 supplies the data signal from the signal generating unit 200, and supplies the pre-emphasis voltage from the pre-emphasis voltage generating unit 202, to the data lines D1 to Dm via the switch unit 206, although the buffer unit 204 may be omitted in other embodiments.

The switch unit 206 controls an electric connection between the buffer unit 204 and the data lines D1 to Dm based on the control signal CS, and for example, the switch unit 206 electrically connects the buffer unit 204 and the data lines D1 to Dm during an operation period. The switch unit 206 controls an electric connection between the buffer unit 204 and the data lines D1 to Dm by being turned on or off during a load-estimating period. Herein, the load-estimating period is a duration in which the first constant and/or the second constant are stored in the storage unit 212.

The comparison unit 208 is connected to the data lines D1 to Dm, and compares a voltage of the data lines D1 to Dm and a voltage of the data signal supplied from the signal generating unit 200 during the load-estimating period, and then supplies a result of the comparison to the control unit 210.

The control unit 210 controls the values of the first constant and/or the second constant depending on the comparison result supplied from the comparison unit 208.

The storage unit 212 stores the first constant and/or the second constant from the control unit 210 in each channel thereof.

Figure 3A:
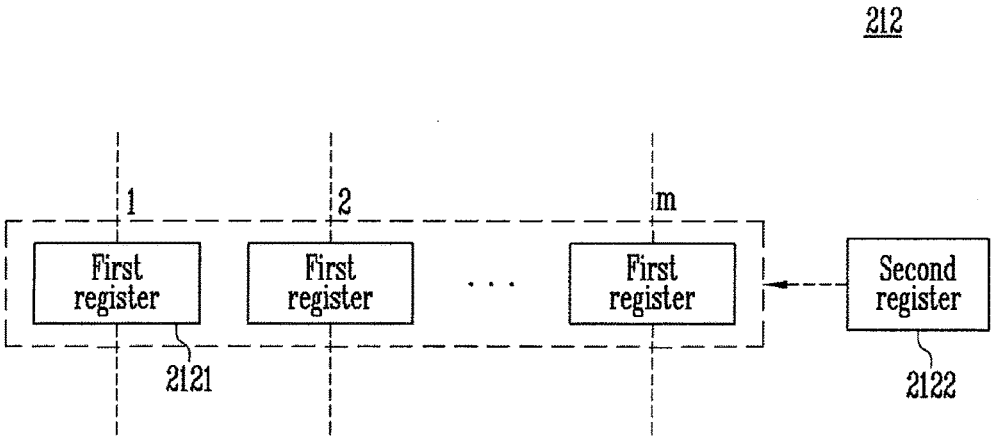
FIG. 3A is a view showing an exemplary embodiment of a storage unit shown in FIG. 2.

FIG. 3A is a view showing an exemplary embodiment of the storage unit shown in FIG. 2.

In FIG. 3A, the storage unit 212 according to the exemplary embodiment of the present disclosure includes first registers 2121, each of which is arranged at a respective channel, and a second register 2122 connected to the entire channels in common.

In each of the first registers 2121, the first constant is stored to control a voltage value of the pre-emphasis voltage, and is stored equivalently and/or differently for each channel according to control of the control unit 210. Additionally, the first constant having an intermediate value between a maximum value and a minimum value, which may be set as initial values, may be stored in the first registers 2121.

In the second register 2122, the second constant is stored to control a supply time of the pre-emphasis voltage. In this case, the second register 2122 is connected to all of the channels in common, and thus the supply time of the pre-emphasis voltage is equivalently set for all channels.

In the present embodiment, the control unit 210 controls the first constant. However, when the control unit 210 controls the second constant, the storage unit 212 may be configured in a way shown in FIG. 3B.

Figure 3B:
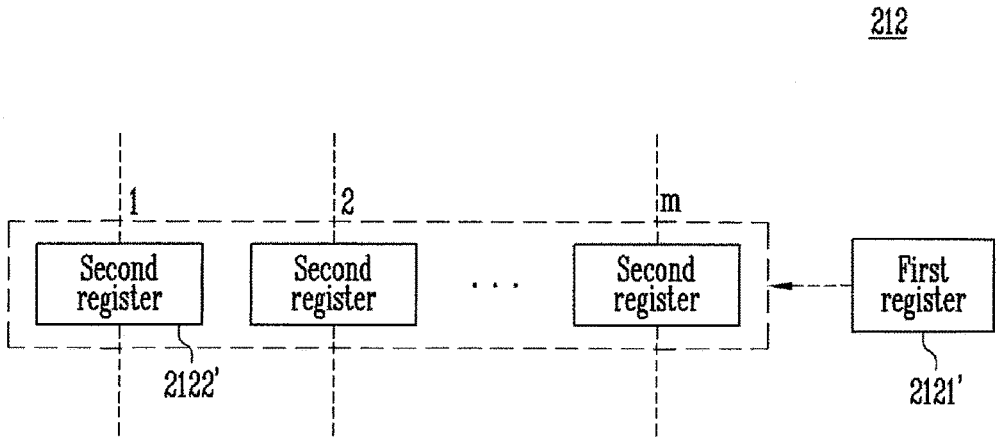
FIG. 3B is a view showing another exemplary embodiment of the storage unit shown in FIG. 2.

FIG. 3B is a view showing another exemplary embodiment of the storage unit shown in FIG. 2.

Referring to FIG. 3B, the storage unit 212 according to another exemplary embodiment of the present disclosure includes second registers 2122', each of which is arranged at a respective channel, and a first register 2121' connected to the all of the channels in common.

In each of the second registers 2122', the second constant is stored to control a supply time of the pre-emphasis voltage, and is stored equivalently or differently for each channel according to a control of the control unit 210. Additionally, the second constant having an intermediate value between a maximum value and a minimum value, which may be set as initial values, may be stored in the second registers 2122'.

In the first register 2121', the first constant is stored to control a voltage value of the pre-emphasis voltage. In this case, the first register 2121' is connected to all of the channels in common, and thus the voltage value of the pre-emphasis voltage is equivalently set for all channels.

Additionally, in the present disclosure, each channel of the storage unit 212 may include both a respective first register and a respective second register. In this case, the control unit 210 controls the first constant value and the second constant value depending on the comparison result supplied from the comparison unit 208.

Figure 4:
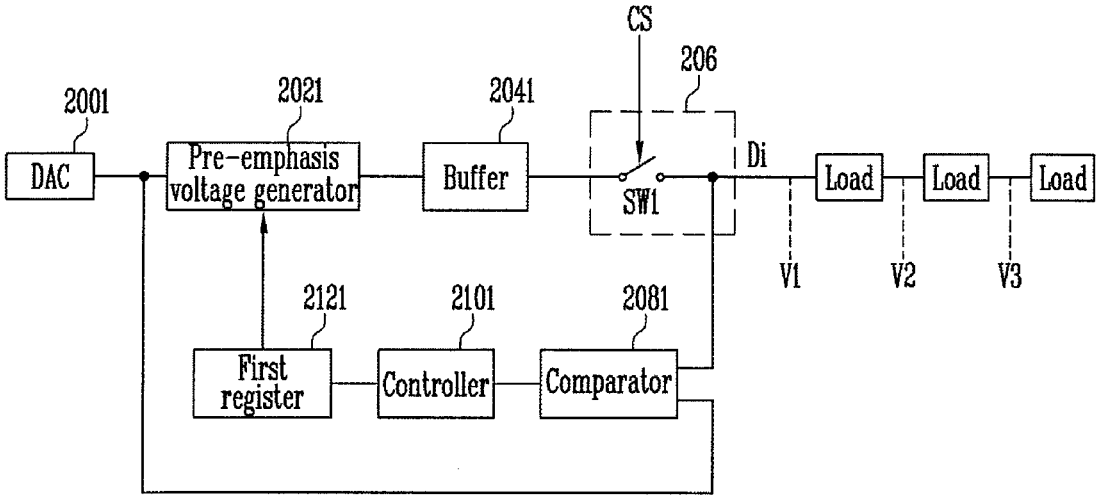
FIG. 4 is a view showing an exemplary embodiment of an i-th channel of the data driver shown in FIG. 2.

FIG. 4 is a view showing an exemplary embodiment of an i-th channel of the data driver shown in FIG. 2.

Referring to FIG. 4, the signal generating unit 200 includes a digital-to-analog converter (DAC) 2001 for generating an analog data signal. The DAC 2001 converts digital image data RGB to an analog data signal.

The pre-emphasis voltage generating unit 202 includes a pre-emphasis voltage generator 2021 provided at each channel to generate the pre-emphasis voltage using the first constant stored in the first register 2121.

The buffer unit 204 includes a buffer 2041 provided at each channel to transmit the pre-emphasis voltage from the pre-emphasis voltage generator 2021, and to transmit the data signal from the DAC 2001 to the data line Di.

The switch unit 206 includes a first switch SW1 provided at each channel, which is turned on when the control signal CS is supplied thereto, and turned off when no control signal CS is supplied thereto.

The comparison unit 208 includes a comparator 2081 provided at each channel. The comparator 2081 compares a voltage of the data signal which is supplied from the DAC 2001, and a voltage of the data line Di during a load-estimating period, and then supplies a result of comparison to a controller 2101.

The control unit 210 includes the controller 2101 provided at each channel. The controller 2101 controls a value of the first constant depending on the comparison result supplied from the comparator 2081. For this purpose, the controller 2101 may be configured by a successive approximation register (SAR).

The storage unit 212 includes the first register 2121 provided at each channel to store the first constant therein. In this case, the second constant may be stored in the second register 2122 shown in FIG. 3A.

The first switch SW1 provided at the i-th channel is connected to the i-th data line Di. This data line Di is formed to have a parasitic capacitor and resistance according to a formation method. Accordingly, the data line Di has corresponding loads and may have voltages V1, V2, and V3, which are differently set according to positions of the loads. For this reason, the first constant may be set in consideration of the loads of the data line Di in the present disclosure.

Figure 5:
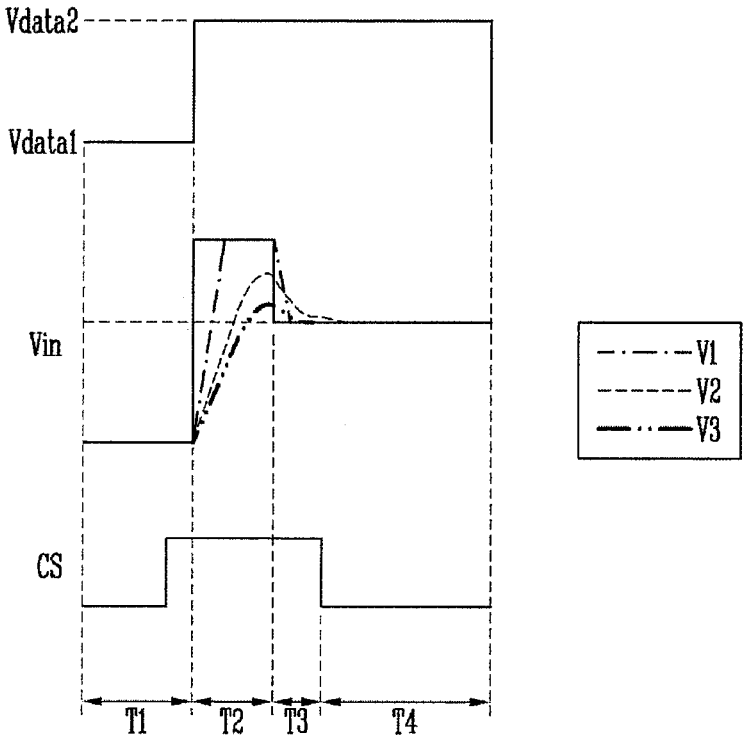
FIG. 5 is a view showing an exemplary embodiment of an operation process during a load-estimating period.

FIG. 5 is a view showing an exemplary embodiment of an operation process during a load-estimating period. In FIG. 5, Vin is a voltage to be supplied to an i-th channel, and the load-estimating period may be provided once or more after a power is supplied to the display device.

Referring to FIG. 4 and FIG. 5, the DAC 2001 supplies a first data signal Vdata1 to a first switch SW1 during a first period T1. A control signal CS is supplied during at least a partial period of the first period T1, thereby turning on the first switch SW1. When the first switch SW1 is turned on, the first data signal Vdata1 is supplied from the DAC 2001 to the data line Di.

During a second period T2, the DAC 2001 supplies a second data signal Vdata2, which is set to have a different voltage value than the first data signal Vdata1. For example, the first data signal Vdata1 may have the lowest voltage among the signals supplied from the data driver 120, while the second data signal Vdata2 has the highest voltage among the signals supplied from the data driver 120.

During the second period T2, the pre-emphasis voltage generator 2021 generates a pre-emphasis voltage using the first constant stored in the first register 2121. For example, the pre-emphasis voltage generator 2021 may generate the pre-emphasis voltage by multiplying a voltage gap/difference between the second data signal Vdata2 and the first data signal Vdata1 by the first constant. The generated pre-emphasis voltage is supplied to the data line Di through the buffer 2041 and the first switch SW1.

During a third period T3 after the pre-emphasis voltage is supplied to the data line Di, the supply of the pre-emphasis voltage stops, and the DAC supplies the second data signal Vdata2 to the data line Di through the buffer 2041 and the first switch SW1.

During a fourth period T4, the supply of the control signal CS stops, and the first switch SW1 is turned off, whereby the data line Di is set in a floating state. In this case, the voltages V1, V2, and V3 for the respective positions of the data line Di are equally set by a charge sharing of the parasitic capacitors.

In this case, the comparator 2081 compares a voltage of the data line Di and a voltage of the second data signal Vdata2 from the DAC 2001, and regards an accurate pre-emphasis voltage as having been supplied to the data line Di if the voltages are equal to or substantially similar to each other, for example, if a difference between the voltages is lower than a predetermined threshold. In this case, the controller 2101 maintains the first constant, which is stored in the first register 2121.

In contrast, the pre-emphasis voltage may be controlled if a voltage of the data line Di and a voltage of the second data signal Vdata2 from the signal generating unit 200 are differently shown in the comparison result of the comparator 2081, for example, if a difference between the voltages exceeds a predetermined threshold. For example, if the voltage of the data line Di is higher than that of the second data signal Vdata2, the controller 2101 lowers a value of the first constant to lower the pre-emphasis voltage, and then stores the lowered first constant value in the first register 2121. Contrastingly, if the voltage of the data line Di is lower than that of the second data signal Vdata2, the controller 2101 raises a value of the first constant to raise the pre-emphasis voltage, and then stores the raised first constant value in the first register 2121.

In these cases, if a successive approximation register (SAR) is used for the controller 2101, the first constant may be set by a value of ¾ or ¼ between the maximum and minimum values, based on the comparison result of the comparator 2081. In addition, the controller 2101 may set the first constant to have a value of ⅞ or ⅝ between the maximum value and minimum value, or ⅜ or ⅛ between the maximum value and minimum value, based on the comparison result of the next comparator 2081. As a result, the controller 2101 may store the first constant in the first register 2121 through repeated comparisons of the comparator 2081.

Figure 6:
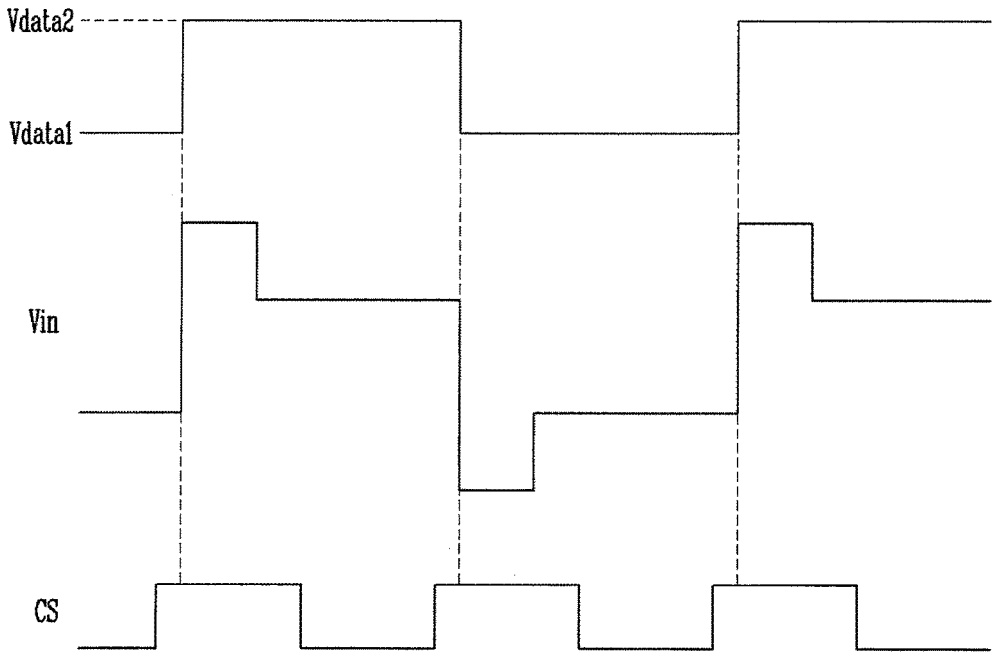
FIG. 6 is a view showing an exemplary embodiment of data signals supplied during the load-estimating period.

For this purpose, during the load-estimating period, the voltages of the first and second data signals Vdata1 and Vdata2 may be repeatedly supplied multiple times, as shown in FIG. 6. As a result, the first constant stored in the first register 2121 allows an optimal pre-emphasis voltage, which is suitable for the loads of the data line Di, to be supplied to the data line Di.

Figure 7:
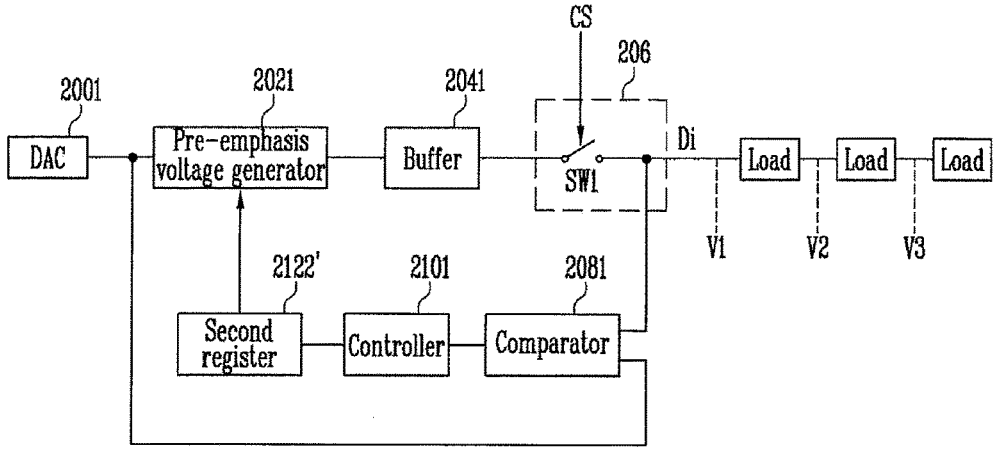
FIG. 7 is a view showing another exemplary embodiment of the i-th channel of the data driver shown in FIG. 2.

FIG. 7 is a view showing another exemplary embodiment of the i-th channel of the data driver shown in FIG. 2. When describing with FIG. 7, the same constituent elements as the exemplary embodiment shown in FIG. 4 are designated by the same reference numerals, and the duplicated description is omitted.

Referring to FIG. 7, the storage unit 212 includes a second register 2122' provided at each channel, which stores the second constant supplied from a controller 2101 therein. In this structure, the first constant may be stored in a first register 2121' as shown in FIG. 3B.

An operation process will be described with reference to FIGS. 5 to 7. A DAC 2001 supplies a first data signal Vdata1 to a first switch SW1 during a first period T1. A control signal CS is supplied during at least a partial period of the first period T1, thereby turning on the first switch SW1, at which point the first data signal Vdata1 is supplied from the DAC 2001 to a data line Di.

During a second period T2, the DAC 2001 supplies a second data signal Vdata2, and a pre-emphasis voltage generator 2021 controls a supply time of the pre-emphasis voltage using the second constant stored in the second register 2122'. The pre-emphasis voltage, which is generated by the pre-emphasis voltage generator 2021, is supplied to the data line Di through a buffer 2041 and the first switch SW1.

During a third period T3, after the pre-emphasis voltage is supplied to the data line Di, the supply of the pre-emphasis voltage stops, and the DAC supplies the second data signal Vdata2 to the data line Di through the buffer 2041 and the first switch SW1.

During a fourth period T4, the supply of the control signal CS stops, and the first switch SW1 is turned off, whereby the data line Di is set in a floating state. In this case, the voltages V1, V2, and V3 for the respective positions of the data line Di are equivalently set by a charge sharing of the parasitic capacitors. In this case, a comparator 2081 compares a voltage of the data line Di and a voltage of the second data signal Vdata2 supplied from the DAC 2001, and a controller 2101 controls a value of the second constant based on a comparison result of the comparator 2081.

For example, if the voltage of the data line Di is higher than that of the second data signal Vdata2, the controller 2101 may lower the second constant value to reduce a supply time of the pre-emphasis voltage. Contrastingly, if the voltage of the data line Di is lower than that of the second data signal Vdata2, the controller 2101 may raise the second constant value to increase a supply time of the pre-emphasis voltage.

That is, during the load-estimating period, the voltage of the data line Di comes to be equal or substantially similar to that of the second data signal Vdata2 by controlling the second constant value, and thus the optimal pre-emphasis voltage suitable for the loads of the data line Di is supplied.

Meanwhile, the first register 2121 of FIG. 4 and the second register 2122' of FIG. 7 may each be provided at each channel. In this case, the controller 2101 controls the first and second constant values in a similar manner based on the comparison result of the comparator 2081. The remaining operation process is omitted since it is same as the above description of FIGS. 4 to 7.

Example embodiments have been disclosed herein and although specific terms are employed, they are used and are to be interpreted in a generic and descriptive sense only and not for purpose of limitation. In some instances, as would be apparent to one of ordinary skill in the art as of the filing of the present application, features, characteristics and/or elements described in connection with a particular embodiment may be used singly or in combination with features, characteristics and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. A display device comprising:

pixels at respective crossing regions of scan lines and data lines;

a scan driver that is configured to supply a scan signal to the scan lines; and a data driver that is configured to:

supply a pre-emphasis voltage to the data lines using a first constant for controlling a voltage value of the pre-emphasis voltage, and using a second constant for controlling a supply time of the pre-emphasis voltage; and supply data signals to the data lines after the supply of the pre-emphasis voltage, wherein at least one of the first or second constants is stored in each channel corresponding to each of the data lines, and is set by reflecting a load characteristic of each of the data lines, wherein an i-th (i is a natural number) channel of the data driver comprises:

a pre-emphasis voltage generator for generating the pre-emphasis voltage using at least one of the first constant and the second constant; and a first switch for controlling a connection between the pre-emphasis voltage generator and an i-th data line of the data lines, and wherein the first switch is configured to be turned off after a first data signal, the pre-emphasis voltage, and a second data signal are successively supplied to the i-th data line during a load-estimating period.

2. The display device of claim 1, wherein the i-th (i is a natural number) channel of the data driver further comprises:

a digital-to-analog converter for generating the data signals;

a first register for storing the first constant;

a comparator for comparing a voltage of the i-th data line and voltages of the data signals; and a controller for controlling a value of the first constant based on a comparison result of the comparator.

3. The display device of claim 2, wherein the i-th channel of the data driver further comprises a buffer between the pre-emphasis voltage generator and the first switch.

4. The display device of claim 2, wherein the data driver further comprises a second register for storing the second constant.

5. The display device of claim 2, wherein the first register is configured to store the first constant that is set to an intermediate value between a maximum value and a minimum value as an initial value.

6. The display device of claim 2, wherein the digital-to-analog converter is configured to supply the first data signal and the second data signal that is different than the first data signal at least two or more times during the load-estimating period in which a value of the first constant is controlled.

7. The display device of claim 6, wherein the first switch is configured to be turned off after the first data signal, the pre-emphasis voltage, and the second data signal are successively supplied to the i-th data line during the load-estimating period.

8. The display device of claim 2, wherein the comparator is configured to compare a voltage of the i-th data line and a voltage of the second data signal after the first switch is turned off.

9. The display device of claim 1, wherein the i-th (i is a natural number) channel of the data driver further comprises:

a digital-to-analog converter for generating the data signals;

a second register for storing the second constant;

a comparator for comparing a voltage of the i-th data line and voltages of the data signals; and a controller for controlling a value of the second constant stored in the second register based on a comparison result of the comparator.

10. The display device of claim 9, wherein the data driver further comprises a first register for storing the first constant.

11. The display device of claim 9, wherein the second register is configured to store the second constant that is set to an intermediate value between a maximum value and a minimum value as an initial value.

12. The display device of claim 9, wherein the digital-to-analog converter is configured to successively supply the first data signal and the second data signal different than the first data signal at least two or more times during a load-estimating period in which a value of the second constant is controlled.

13. The display device of claim 12, wherein the first switch is configured to be turned off after the first data signal, the pre-emphasis voltage, and the second data signal are successively supplied to the i-th data line during the load-estimating period.

14. The display device of claim 13, wherein the comparator is configured to compare a voltage of the i-th data line and a voltage of the second data signal after the first switch is turned off.

15. A method for driving an organic light emitting display device using a load-estimating period in which at least one of a voltage value of a pre-emphasis voltage and a supply time of the pre-emphasis voltage is controlled, wherein, during the load-estimating period, the method comprises:

supplying a first data signal and a second data signal different than the first data signal to an i-th (i is a natural number) data line;

supplying the pre-emphasis voltage in an early stage in which the second data signal is supplied;

floating the i-th data line after the pre-emphasis voltage and the second data signal are supplied;

comparing a voltage of the i-th data line and a voltage of the second data signal; and controlling at least one of a voltage value and a supply time of the pre-emphasis voltage based on the comparing, wherein the i-th data line is not floated between the supplying the pre-emphasis voltage and the supplying the second data signal.

16. The method of claim 15, wherein the controlling at least one of the voltage value and the supply time of the pre-emphasis voltage comprises controlling at least one of a first constant for determining the voltage value of the pre-emphasis voltage, or a second constant for determining the supply time of the pre-emphasis voltage.

17. The method of claim 16, wherein at least one of the first and second constants is controlled such that the voltage of the i-th data line and a voltage of the second data signal are similar.

18. The method of claim 15, wherein the supplying the first data signal and the second data signal comprises supplying the first and second data signals two or more times during the load-estimating period.

19. The method of claim 15, wherein the first data signal is a signal of a lowest voltage supplied from a data driver, and wherein the second data signal is a signal of a highest voltage supplied from the data driver.

20. The method of claim 15, wherein the load-estimating period is after a power is supplied to the display device.

* * * * *